US005140805A

United States Patent [19]

Sterchele

[11] Patent Number: 5,140,805

[45] Date of Patent: Aug. 25, 1992

[54] DEVICE TO CHECK THE PRESENCE OF THREADS ON SPINNING MACHINES

[75] Inventor: Paolo Sterchele, Lison di Portogruaro (VE), Italy

[73] Assignee: Zignago Tessile SpA, Fossalta di Portogruaro (VE), Italy

[21] Appl. No.: 651,639

[22] Filed: Feb. 6, 1991

[30] Foreign Application Priority Data

Feb. 14, 1990 [IT] Italy ..... 83333 A/90

[51] Int. Cl.[5] ..... D01H 7/92; D02G 3/36

[52] U.S. Cl. ..... 57/264; 57/81

[58] Field of Search ..... 57/264, 265, 296, 297, 57/298, 75, 81; 73/602, 584, 593; 340/670

[56] References Cited

U.S. PATENT DOCUMENTS

| | | | |
|---|---|---|---|
| 2,930,180 | 3/1960 | Adams et al. | 57/81 |
| 3,182,489 | 5/1965 | Hamilton | 73/584 X |
| 3,745,815 | 7/1973 | Bentone et al. | 73/593 |
| 3,751,893 | 8/1973 | Goodhue et al. | 57/81 X |
| 3,842,663 | 10/1974 | Harting et al. | 73/593 |
| 3,914,754 | 10/1975 | Kirk | 73/593 X |
| 3,969,882 | 7/1976 | Cilloniz Oberti | 57/293 X |
| 4,023,341 | 5/1977 | Saino et al. | 57/81 |
| 4,027,232 | 5/1977 | Domiq et al. | 57/81 X |
| 4,656,822 | 4/1987 | Meissner et al. | 57/81 |
| 4,683,712 | 8/1987 | Peters | 57/81 |
| 4,788,818 | 12/1988 | Meissner | 57/81 X |

FOREIGN PATENT DOCUMENTS

| | | | |
|---|---|---|---|
| 942791 | 11/1963 | United Kingdom | 57/81 |

OTHER PUBLICATIONS

P. D. McFadden, Low Frequency Vibration Generated by Gear Tooth Impacts, Oct. 1985, NDT International vol. 18 #5.

*Primary Examiner*—Daniel P. Stodola
*Assistant Examiner*—Michael R. Mansen
*Attorney, Agent, or Firm*—Antonelli, Terry, Stout & Kraus

[57] ABSTRACT

Device to check the presence of threads on spinning machines (11), which is fitted to a stationary ring rail (15) and cooperates with a traveller (18) set in rotation on a ring (16) by the thread (17), the device (10) at least governing an arresting and cutting means (21) and comprising a microphonic sensor (27) actuated by the shock waves due to the passage of the traveller (18).

9 Claims, 4 Drawing Sheets 30
27
26

27
A
26
30
B
10

29
28
24
27
45
30

27
31
26
10

26
30

DEVICE TO CHECK THE PRESENCE OF THREADS ON SPINNING MACHINES

BACKGROUND OF THE INVENTION

This invention concerns a device to check the presence of threads on spinning machines. To be more exact, the invention is applied properly to ring spinning machines.

The invention can be fitted to any spinning machine and is especially advantageous in the case of wet spinning frames for linen or other analogous fibers or the like.

It is known that on spinning machines it is necessary to provide a detector which senses whether or not the thread is passing through.

In fact, if there is no thread, this means that the spool is not being fed and that the spindle is rotating to no purpose; in other words, time and energy are being wasted without achieving any result.

A device to check the presence of the thread in a spinning machine is always associated with another device which is normally positioned upstream of the drafting zone and which serves to halt the thread, so that the thread is not wound on elements in motion and does not damage them or else so that there is no loss of thread being sent to waste.

Devices to check the presence of the thread are known and are of various types. One type includes a sensor to detect the presence of the thread and, if the thread is lacking, a circuit to actuate a thread-arresting device is actuated. Such a type of sensor may be mechanical with a lever or be piezoelectric, or may include a photosensitive element or may operate by Hall effect or with an encoder-type position transducer, etc.

However, these types of sensor are not advantageous in given types of processing on spinning machines, nor are they advantageous with certain types of yarn.

To obviate the drawbacks of these types of sensors, a sensor has been proposed in EP-A-0329618 and is fitted to the ring rail and detects the regular passage of the metallic thread-guide traveller.

This metallic thread-guide traveller in passing in front of the sensor modifies periodically the magnetic field which affects the sensor. By measuring and processing these periodic modifications, a signal indicating the presence or otherwise of the thread is obtained.

This device, which is very accurate and reliable in itself, is no longer accurate when the thread-guide traveller is made of plastic or, at any rate, of a material which has no effect on the sensible magnetic field that affects the sensor.

In this case, where the yarn to be processed requires a thread-guide traveller made of a non-magnetic material, it is necessary to forgo these sensors fitted to the ring rail and to employ sensors that act in direct cooperation with the thread.

As we said earlier, these sensors are less accurate and reliable and also require continuous maintenance work to keep them at a reliable quality level. In fact, the presence of dirt mixed with water lessens the reliability of these sensors considerably.

Document WO-A-88/08047 discloses a sensor which is intended to check the unit length weight or linear density of a sliver being processed. The signal arriving from the sensor positioned in a trumpet has the purpose of regulating the speed of the drawing rolls so as to obtain the greatest possible uniformity of the sliver. The sensor disclosed in this document monitors the acoustic emissions caused by natural compression of the fibers against each other and by their contact with the trumpet through which they are compelled to pass. Therefore, the field of employment of the sensor and its functional nature are clearly different from those for which the sensor of our invention is used.

Document FR-A-2.161.471 discloses a system to monitor the presence of the thread on the basis of the fact that the thread modifies an acoustic signal coming from an emitter of ultrasonic sounds. This system is different from our invention under examination owing to the fact that the acoustic source is produced not in a natural manner by the thread and/or the traveller rotating on the ring of the spinning machine but artificially by an emitter of ultrasonic sounds, and also because the system consists of two active components, namely an emitter and a receiver, and also owing to the fact that this system monitors directly the presence of the thread and works in the field of ultrasonic sounds. All these differences together make the teaching of FR-A-2.161.471 not capable of being applied to the problems which our invention purposes to overcome.

The present applicant has therefore tackled this problem in seeking a solution which meets requirements satifactorily.

SUMMARY OF THE INVENTION

The device to check the presence of thread on spinning machines according to the invention is set forth and characterized in the main claim, while the dependent claims describe variants of the idea of the original solution.

According to the invention, a microphonic sensor is located in cooperation with a radial position of the circumferential path of the traveller.

By microphonic sensor is meant any type of element sensitive to sound, such as a variable contact transducer, a moving-iron transducer, an electrostatic transducer, a piezoelectric transducer, a moving-coil transducer, etc., and equivalent circuit means. This microphonic sensor is anchored advantageously to the ring rail.

According to a variant the microphonic sensor is lodged in a waterproof protective container and is sunk in at least one damping substance.

According to a further variant a unit to process at least partly the signal received from the microphonic sensor is also lodged within the protective container.

The microphonic sensor detects the cycles of rarefied air and compressed air which accompany the passage of the thread-guide traveller. These cycles are sensed by the sensor as pressure waves and therefore as a regular variation of the noise generated by the traveller; this noise laps the microphonic sensor.

When the traveller does not rotate since the thread is broken and does not set the traveller in rotation, the microphonic sensor is lapped only by background noise.

According to the invention the container, if included, will have an outer width and height ranging from 1.5 to 3 cms. and will have advantageously, but not only, a circular section.

The microphonic sensor is lodged within the container and will take up advantageously at least a third of the length of the container. The length of the container is normally between 1.5 and 4 cms.

The container may be positioned on the ring rail in a stationary position, or else the means which secure the container will be able to adjust the radial position of the container in relation to the guide ring of the thread-guide traveller.

Depending on the conformation of the container and the characteristics of the microphonic sensor, if the traveller rotates at 7000 revolutions a minute, the distance of the container from the ring will be between 3 and 7 mm.

According to the invention the axis of the microphonic sensor, or of the container, cooperates with the vicinity of the upper part of the ring.

The microphonic sensor cooperates with electronic means that amplify, eliminate extraneous noise from and structure the signal, and with control and actuation means. The control and actuation means govern a device that cuts and arrests the thread.

Operational-machine control and governing means are comprised.

BRIEF DESCRIPTION OF THE DRAWINGS

The attached figures, which are given as a non-restrictive example, show the following.

DETAILED DESCRIPTION OF THE PREFERRED EMBODIMENTS

Figure 1:
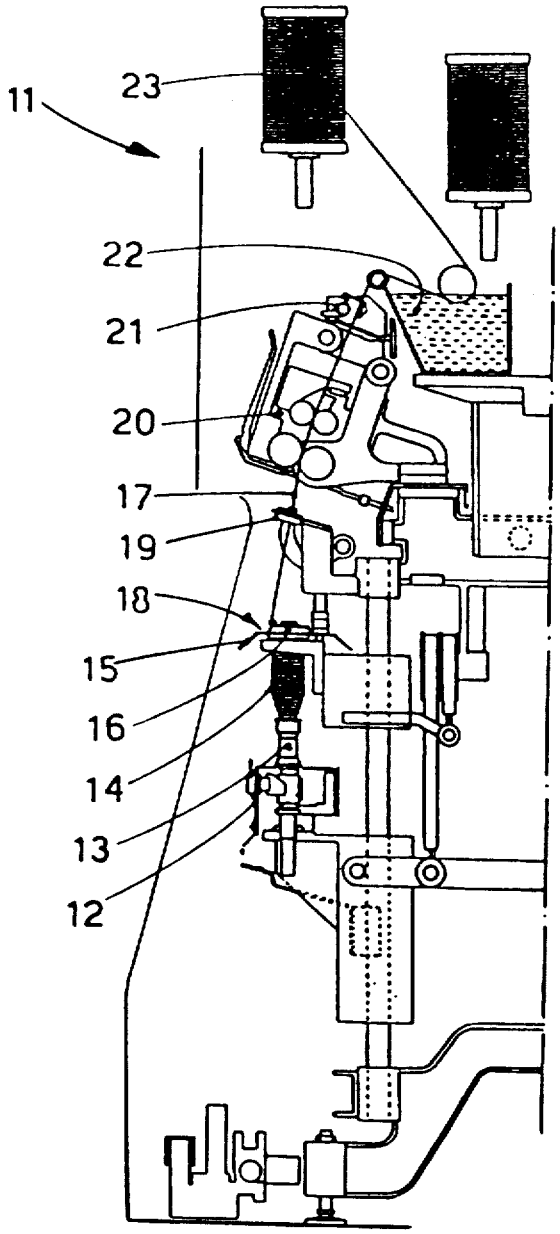
FIG. 1 is a side view of a possible wet spinning frame for linen.
Figure 2:
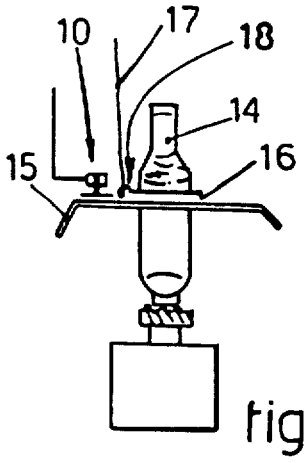
FIG. 2 shows a possible installation of the invention.
Figure 3A:
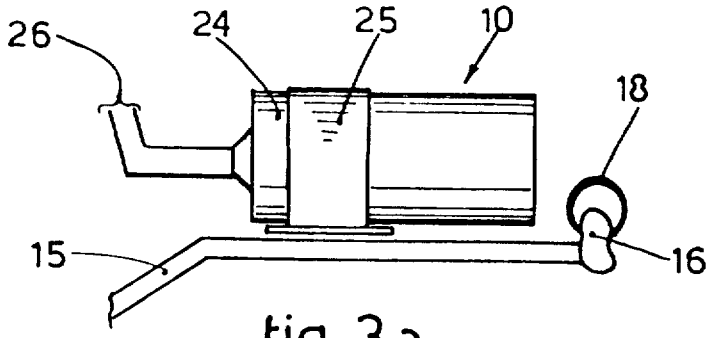
FIGS. 3 show side and plan views of the installation of FIG. 2.
Figure 3B:
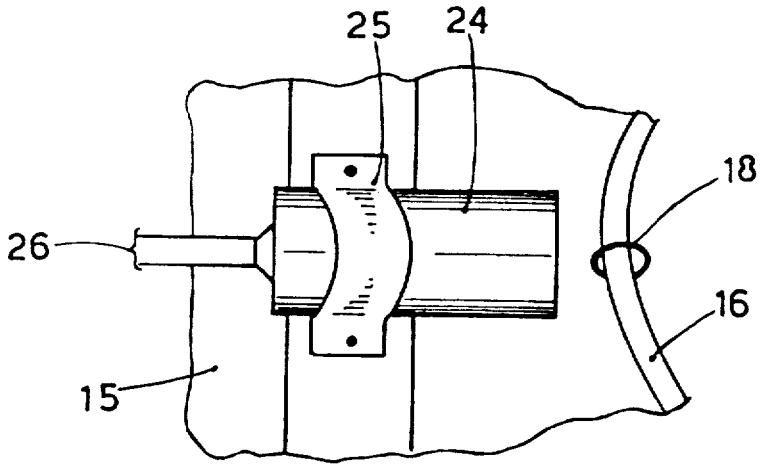

In the figures a spinning machine 11 comprises a movable spindle holder 12 that bears spindles 13 on which are fitted tubes 14 to accommodate the relative roving packages.

The tube 14 is made vertically movable by the movable spindle holder 12 and cooperates with a stationary rail 15.

A ring 16, on which a relative traveller 18 runs and is drawn by thread 17, is included on the stationary rail 15 for each tube 14.

A guide plate 19, drafting unit 20, thread arresting means 21 which also serves to cut the roving, a moistening vessel 22 in this case and a roving package 23 are positioned above the ring 16.

A proximity sensor of a known type which detects the thread is normally fitted on the guide plate 19 but, as we said above, this invention has the purpose of substituting that sensor of a known type.

According to a variant both the sensor fitted on the guide plate 19 and a device 10 according to the invention positioned on the stationary ring rail 15 may be included.

In the example shown the device 10 is installed on the rail 15 by means of a strap 25, which clamps a container 24 whence electrical cables 26 emerge.

The container 24 has its axis in a radial position in relation to the ring 16 and can be adjusted axially in relation to the ring 16 by means of the strap 25.

In this case the axis of the container 24 cooperates with the path of the passage of the traveller 18 so as to obtain the greatest impact from the shock wave.

According to a variant the axis of the container 24 lies substantially on a plane parallel to the plane of sliding of the traveller 18 but at an angle to the radial position of the ring 16.

This angle may reach even a value of about fifteen degrees, depending on the type of microphonic sensor 27 employed, the characteristics of the container 24 and the speed of rotation of the traveller 18.

When the thread 17 passes the device 10, the signal received by the device 10 (FIG. 4*a*), if transmitted to a signal system 33 by an amplifier 32, has a conformation whereby, unless there are disturbances, the peaks indicate the compression and rarefaction of the air.

Figures 4A, 4B:
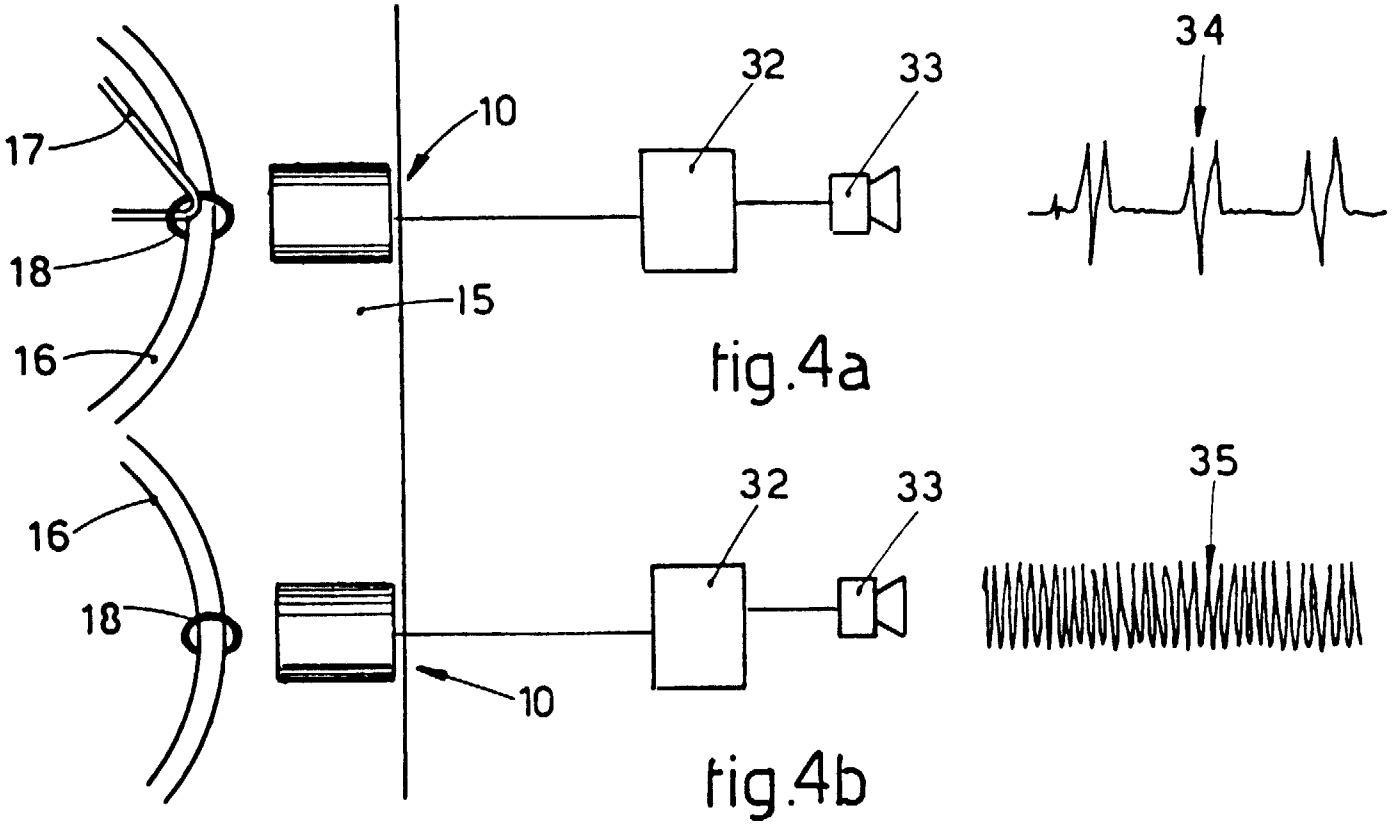
FIGS. 4 show the working principle.

If the thread 17 does not pass the device 10, the signal received has the conformation shown by 35 in FIG. 4*b* and represents the background noise.

Figure 5:
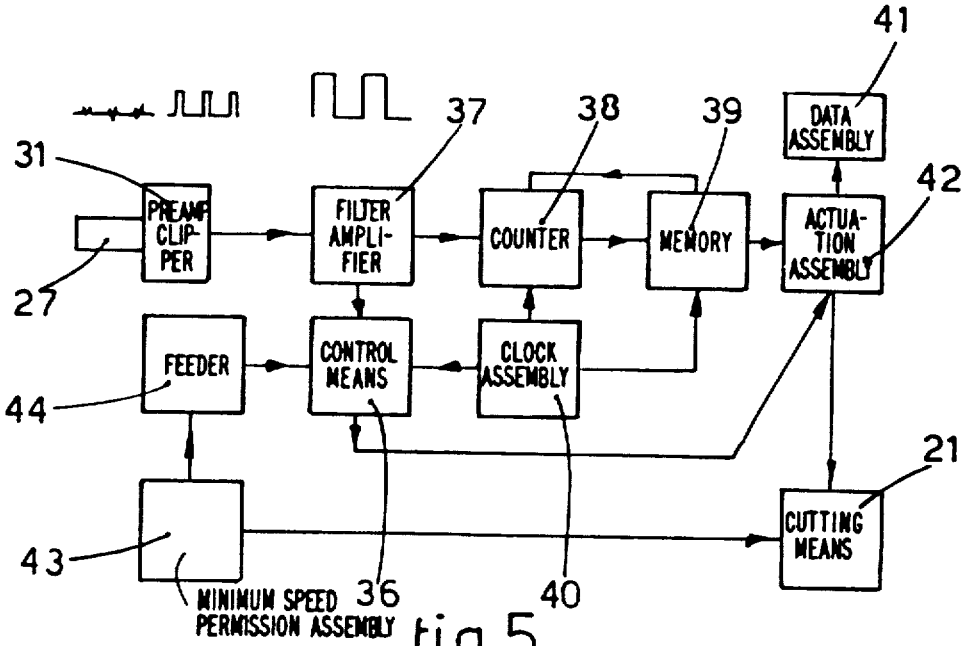
FIG. 5 is a possible processing, control and actuation circuit.

FIG. 5 shows a possible electrical block diagram associated with the device 10.

This electrical block diagram includes a preamplifier-clipper 31, a filter amplifier 37, a counter 38, a memory 39, a clock assembly 40, a data assembly 41 and a power actuation assembly 42 which governs the arresting and cutting means 21.

In this example the arresting and cutting means 21 is also governed by a minimum-speed permission assembly 43, which in turn gives permission to the feeder 44 of the electronic apparatus.

The filter amplifier 37, clock assembly 40 and feeder 44 govern a control means 36, which actuates the power actuation assembly 42, if the device 10 has broken down, so as to perform cutting of the thread by means of the arresting and cutting means 21.

Figures 6A, 6B, 6C, 6D, 6E:
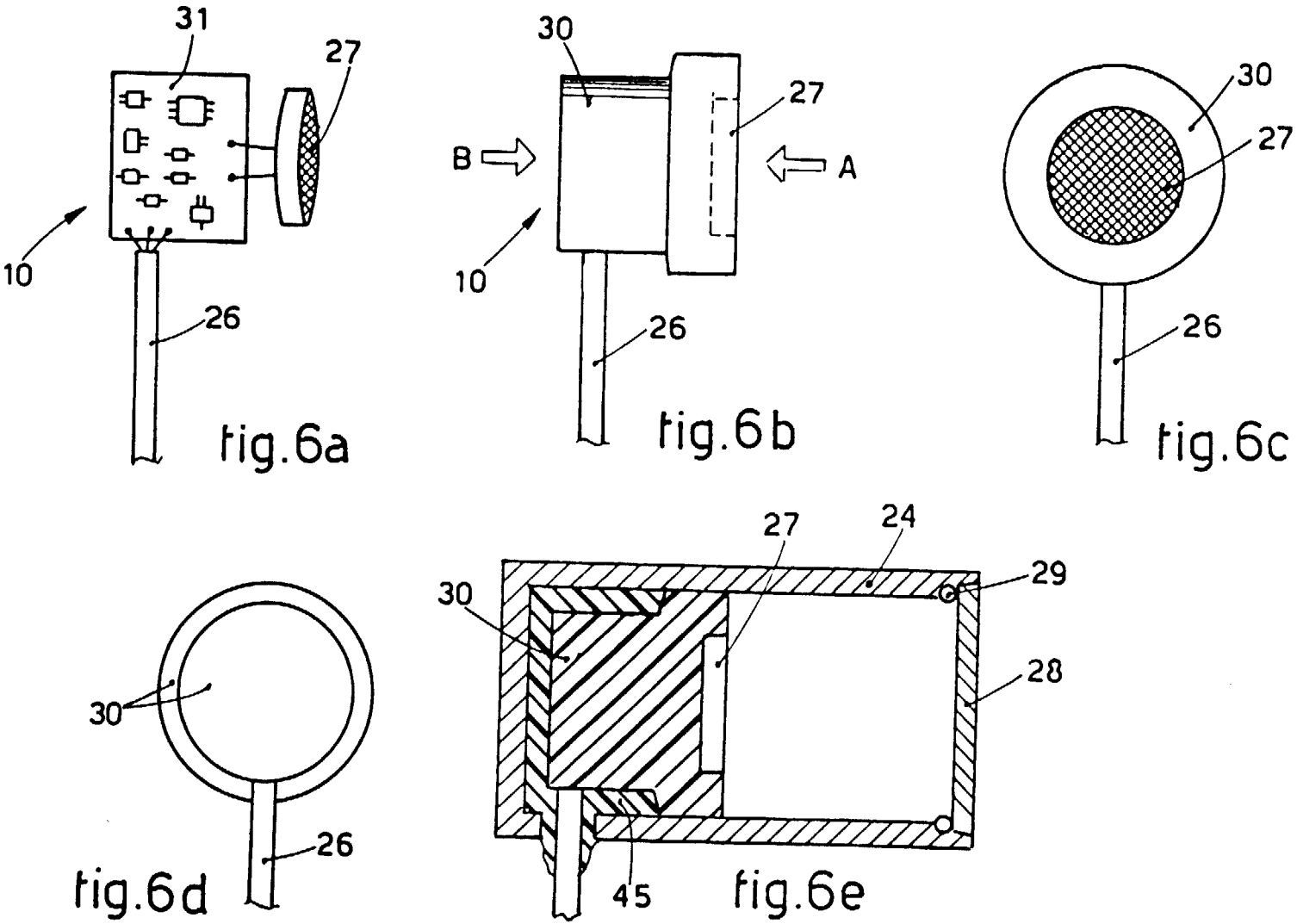
FIGS. 6 show a possible embodiment of the invention in conjunction with a container.

FIG. 6*a* shows a form of embodiment of the device 10 in which are illustrated the microphonic sensor 27 and preamplifier-clipper 31 before they undergo a resin-coating operation.

FIG. 6*b* shows the device 10 of FIG. 6*a* after the resin-coating operation, whereby the microphonic sensor 27 is associated with the preamplifier-clipper 31 by application of a resin 30.

FIGS. 6*c* and 6*d* are views of FIG. 6*b* according to the lines of the arrows A and B respectively.

FIG. 6*e* shows a lengthwise section of the device 10 inserted together with resin 30 into a metallic or plastic container 24.

The device 10 is anchored advantageously to the container 24 by a dope 45; the body of the container 24 is shut with a cover 28 and toroidal ring 29.

If the container 24 is metallic, it may have a width and height or diameter of 1.5 to 3 cms. and a length of 1.5 to 4 cms.

I claim:

1. Device to check the presence of threads on spinning machines, which is fitted to a stationary ring rail and cooperates with a traveller set in rotation on a ring by the thread, the device at least operating means for arresting and cutting thread and being characterized in that the device comprises a microphonic sensor actuated by sound waves due to the passage of the traveller.

2. Device as claimed in claim 1, in which the microphonic sensor is suspended and contained in a container, which has its axis lying substantially on the plane of the sliding of the traveller and oriented towards the vertical axis of the ring.

3. Device as claimed in claim 2, in which a fixture dope anchors the microphonic sensor in the container.

4. Device as claimed in claim 2, in which the microphonic sensor is electrically connected to processing means for processing the signal received from the microphonic sensor, said processing means providing a signal which controls said arresting and cutting means.

5. Device as claimed in claim 4, in which at least some of the processing means are contained in a circuit provided within the container.

6. Device as claimed in claim 5, in which at least the microphonic sensor and the circuit are provided together with a resilient resin coating.

7. A spinning machine comprising:

a source of thread;

a drafting unit through which said thread passes;

thread arresting means for arresting and cutting said thread at a point between said source of thread and said drafting unit;

a spindle on which a tube is provided to receive spun thread;

a stationary ring rail cooperating with said spindle and provided with a ring on which is provided a traveller which rotates around said ring as said traveller is drawn by thread;

a microphonic sensor provided on said stationary ring rail and spaced a predetermined distance from said traveller and thread running therethrough, said microphonic sensor being sensitive to sound generated by pressure waves caused by rotation of said traveller around said ring;

processing means for processing signals from said microphonic sensor to provide a processed signal reflecting the presence or absence of thread passing through said traveller;

control means for operating said thread arresting means based on said processed signal.

8. A spinning machine according to claim 7, wherein said microphonic sensor is provided in a container and said container is spaced a predetermined distance from said traveller and thread running therethrough.

9. A spinning machine according to claim 7, further comprising a moistening vessel for moistening said thread before passes through said drafting unit.

* * * * *